US009855744B2

(12) United States Patent
Yabe

(10) Patent No.: US 9,855,744 B2
(45) Date of Patent: Jan. 2, 2018

(54) LIQUID EJECTION HEAD AND INKJET PRINTING APPARATUS WITH REINFORCED FLOW PATH FORMING MEMBER

(71) Applicant: CANON KABUSHIKI KAISHA, Tokyo (JP)

(72) Inventor: Kenji Yabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/260,709

(22) Filed: Sep. 9, 2016

(65) Prior Publication Data

US 2017/0087838 A1 Mar. 30, 2017

(30) Foreign Application Priority Data

Sep. 25, 2015 (JP) ..... 2015-188146

(51) Int. Cl.
*B41J 2/14* (2006.01)

(52) U.S. Cl.
CPC ..... *B41J 2/14145* (2013.01)

(58) Field of Classification Search
CPC ..... B41J 2/1433; B41J 2/14145; B41J 2/1404
See application file for complete search history.

(56) References Cited

U.S. PATENT DOCUMENTS 5,218,376 A 6/1993 Asai
5,463,413 A * 10/1995 Ho ..... B41J 2/1404 347/65
6,155,673 A 12/2000 Nakajima et al.
6,158,843 A * 12/2000 Murthy ..... B41J 2/1404 347/47
6,283,584 B1 * 9/2001 Powers ..... B41J 2/1404 347/65
6,488,364 B1 12/2002 Nakajima et al.
6,540,335 B2 * 4/2003 Touge ..... B41J 2/1404 347/65
6,575,560 B2 6/2003 Kaneko et al.
6,652,079 B2 11/2003 Tsuchii et al.
7,628,469 B2 12/2009 Inoue
(Continued)

FOREIGN PATENT DOCUMENTS

JP 04-010940 A 1/1992
JP 2007-283501 A 11/2007

*Primary Examiner* — Juanita D Jackson
(74) *Attorney, Agent, or Firm* — Fitzpatrick, Cella, Harper & Scinto

(57) ABSTRACT

A liquid ejection head for ejecting a liquid includes a substrate provided with an energy generating element and a liquid supply port; a flow path forming member including an ejection opening for ejecting a liquid; and a pressure chamber communicating with the ejection opening and including the energy generating element therein and a flow path through which the pressure chamber and the liquid supply port communicate with each other, the pressure chamber and the flow path being provided between the substrate and the flow path forming member. A portion of the flow path forming member which extends from an area facing the liquid supply port to an area facing a part of the flow path extending from the liquid supply port to the pressure chamber has a thickness greater than that of a portion of the flow path forming member which faces the pressure chamber.

8 Claims, 8 Drawing Sheets

(56) References Cited

U.S. PATENT DOCUMENTS

| | | | |
|---|---|---|---|
| 9,038,268 | B2 | 5/2015 | Yamane et al. |
| 2013/0286098 | A1 | 10/2013 | Yabe et al. |
| 2016/0288502 | A1 | 10/2016 | Iijima et al. |

* cited by examiner

LIQUID EJECTION HEAD AND INKJET PRINTING APPARATUS WITH REINFORCED FLOW PATH FORMING MEMBER

BACKGROUND OF THE INVENTION

Field of the Invention

The present invention relates to a liquid ejection head and an inkjet printing apparatus, and more particularly, a technique of increasing a strength of a member forming a liquid flow path in a liquid ejection head.

Description of the Related Art

As such a type of technique, Japanese Patent Laid-Open No. 2007-283501 discloses a technique in which a reinforcing member is provided to a portion of the member, which forms a liquid flow path of a liquid ejection head and faces a liquid supply port. More specifically, in the disclosed technique, a beam-shaped protrusion is provided to a portion of a flow path forming member facing the liquid supply port which is a cavity formed through a substrate of the liquid ejection head so as to increase a thickness toward the substrate, and reinforcing ribs are provided to extend from the beam-shaped protrusion so as to approach a flow path communicating with an ejection opening.

According to the above structure, when a force deforming the flow path forming member toward the substrate is exerted on the flow path forming member, the deformation can be prevented by allowing the reinforcing ribs to be in contact with the substrate, and as a result, the strength of the flow path forming member can be further increased.

However, in the case of a liquid ejection head where ejection openings are arranged with a relatively high density, the arrangement of the reinforcing ribs may cause adverse effects. More specifically, the reinforcing ribs are arranged with a high density, and thus, a space surrounded by the reinforcing rib and the ink flow path that communicates with the ejection opening, that is, a communicating passage between the ink flow path and the liquid supply port is narrowed, so that flow of liquid between each ink flow path and the liquid supply port is obstructed. As a result, for example, circulation of liquid between the ink flow path and the liquid supply port is suppressed, and thus, ink thickening or the like occurs, so that ejection performance may be deteriorated.

SUMMARY OF THE INVENTION

The object of the present invention is to provide a liquid ejection head capable of increasing a strength of a flow path forming member without obstructing flow of liquid between an ink flow path and a liquid supply port and an inkjet printing apparatus using the liquid ejection head.

In a first aspect of the present invention, there is provided a liquid ejection head for ejecting a liquid, the liquid ejection head comprising: a substrate provided with an energy generating element and a liquid supply port; a flow path forming member including an ejection opening for ejecting a liquid; and a pressure chamber communicating with the ejection opening and including the energy generating element therein and a flow path through which the pressure chamber and the liquid supply port communicate with each other, the pressure chamber and the flow path being provided between the substrate and the flow path forming member, wherein a portion of the flow path forming member which extends from an area facing the liquid supply port to an area facing a part of the flow path extending from the liquid supply port to the pressure chamber has a thickness greater than a portion of the flow path forming member which faces the pressure chamber.

In a second aspect of the present invention, there is provided an inkjet printing apparatus that performs printing on a print medium by ejecting ink, the apparatus comprising: a liquid ejection head for ejecting ink, the liquid ejection head comprising a substrate provided with an energy generating element and an ink supply port, a flow path forming member including an ejection opening for ejecting ink, and a pressure chamber communicating with the ejection opening and including the energy generating element therein and a flow path through which the pressure chamber and the ink supply port communicate with each other, the pressure chamber and the flow path being provided between the substrate and the flow path forming member, wherein a portion of the flow path forming member which extends from an area facing the ink supply port to an area facing a part of the flow path extending from the ink supply port to the pressure chamber has a thickness greater than a portion of the flow path forming member which faces the pressure chamber; and a printing unit configured to cause the liquid ejection head to eject ink onto the print medium for performing the printing.

According to the above configuration, in a liquid ejection head, it is possible to increase a strength of a flow path forming member without obstructing flow of liquid between an ink flow path and a liquid supply port.

Further features of the present invention will become apparent from the following description of exemplary embodiments (with reference to the attached drawings).

DESCRIPTION OF THE EMBODIMENTS

Hereinafter, embodiments of the present invention will be described with reference to the drawings.

Figure 1:
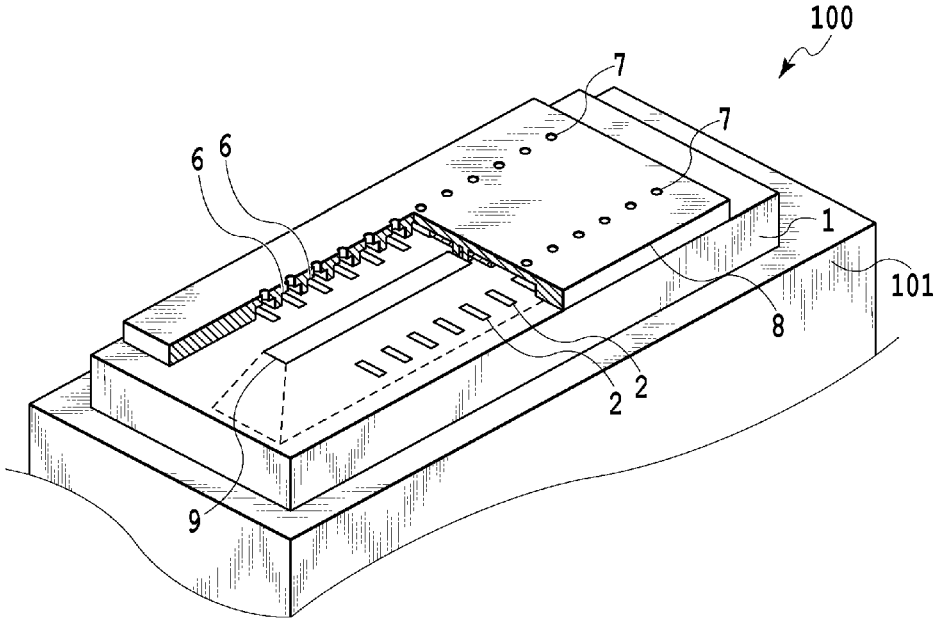
FIG. 1 is a perspective view showing an inkjet printing head according to an embodiment of the invention.

FIG. 1 is a perspective view showing a liquid ejection head according to an embodiment of the present invention with a part thereof being cut away. The liquid ejection head 100 is configured to include a flow path forming member 8 in which a plurality of ejection openings 7 for ejecting ink as liquid are formed and an element substrate 1 on which energy generating elements 2 are provided to correspond to the respective ejection openings 7. The liquid ejection head is used in a form that the liquid ejection head is mounted on an inkjet printing apparatus using ink as liquid. More specifically, the inkjet printing apparatus performs printing by driving the liquid ejection head ejecting ink to eject ink onto a print medium such as a sheet.

The element substrate 1 is formed by using silicon (Si) as a material. In addition, the material is not limited thereto. For example, the element substrate may be formed with a glass, a ceramic, a resin, a metal, or the like. On the top surface of the element substrate 1, electro-thermal converting elements 2 as energy generating elements are provided at positions facing the ejection openings 7 of the flow path forming member 8, and electrodes (not illustrated) for applying voltage to the electro-thermal converting elements 2 and wire lines (not illustrated) connected to the electrodes are provided with a predetermined pattern. By applying voltage pulse to the electro-thermal converting elements 2, an air bubble is generated in ink, and by pressure of the air bubble, the ink can be ejected through the ejection opening 7. In addition, on the top surface of the element substrate 1, an insulating film (not illustrated) which improves a property of dissipation of accumulated heat is provided to cover the electro-thermal converting elements 2. Furthermore, on the top surface of the element substrate 1, a protective film (not illustrated) for protecting from cavitation generated in the defoaming of the air bubble is provided to cover the insulating film. In the element substrate 1, an ink supply port (liquid supply port) 9 that penetrates the element substrate from the rear surface to the top surface is provided. The ink is supplied to an ink flow path and a pressure chamber of each ejection opening through the ink supply port 9 which is commonly provided to a plurality of ejection openings.

The flow path forming member 8 is attached to the element substrate 1, so that the pressure chamber (not illustrated) and the ink flow path 6, 6B for each ejection opening are formed. The pressure chamber contains the electro-thermal converting element 2 inside thereof, and the electro-thermal converting element is driven to generate an air bubble in the ink inside the pressure chamber. The ink flow paths 6 and 6B (refer to FIGS. 2A and 2B) form flow paths of ink between the pressure chambers and the ink supply port 9.

The element substrate 1 is supported by a supporting member 101, and thus, a main part of the liquid ejection head 100 is made.

The liquid ejection head 100 according to the embodiment has two ejection opening columns which are symmetric with respect to a longitudinal axis of the ink supply port 9 of the substrate 1. In each ejection opening column, the ejection openings 7 are arranged at a pitch corresponding to 600 dpi. The two ejection opening columns are disposed to be shifted from each other by ½ of the arrangement pitch. Therefore, in the entire two ejection opening columns, the ejection openings are arranged at a pitch corresponding to 1200 dpi in the arrangement direction. In addition, the liquid ejection head according to the embodiment is configured as such an ejecting type disclosed in, for example, Japanese Patent Laid-Open No. H04-010940(1992) or the like, where the air bubbles generated at the time of ejecting the ink are communicated with external air through the ejection opening, and after that, an ink droplet is separated from the ink inside the pressure chambers to be ejected.

Hereinafter, embodiments of the flow path forming member of the liquid ejection head according to the embodiment of the present invention described above will be described.

(First Embodiment)

Figures 2A, 2B:
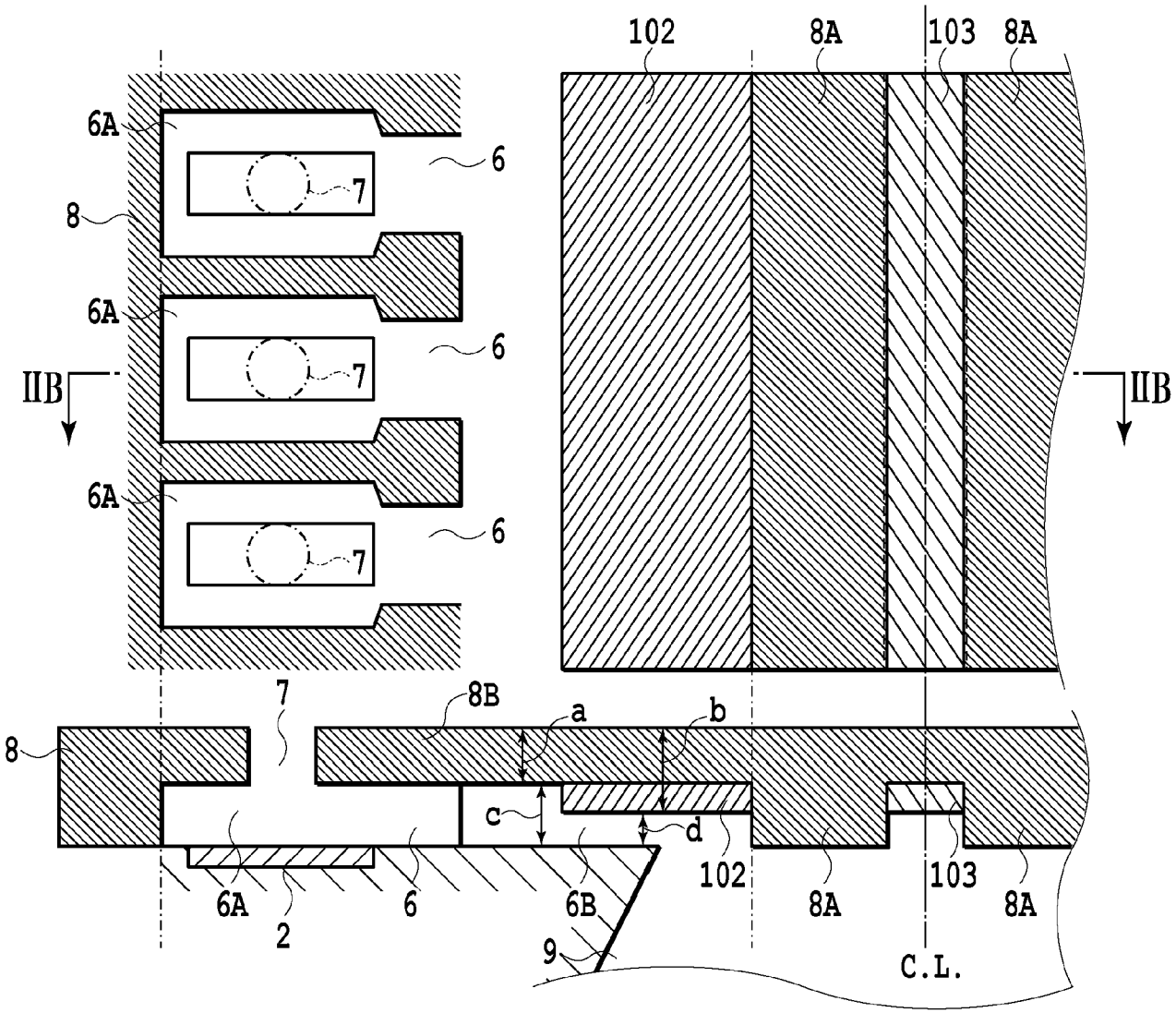
FIGS. 2A and 2B are views mainly showing a structure of a flow path forming member of a liquid ejection head according to the first embodiment of the present invention.

FIGS. 2A and 2B are views mainly showing a structure of a flow path forming member 8 of a liquid ejection head according to a first embodiment of the present invention. More specifically, FIG. 2A is a top view showing the flow path forming member 8 with a top portion (portion having a thickness "a") being excluded so that pressure chambers 6A and ink flow paths 6, 6B appear, and FIG. 2B is a cross-sectional view taken along line IIB-IIB of FIG. 2A and shows a state that the top portion of the flow path forming member 8 is not excluded. In addition, these drawings illustrate the structure of the flow path forming member 8 of the associated portion of one ejection opening column of the two symmetric ejection opening columns, and the axis of symmetry is indicated by a straight line C.L. In addition, in FIG. 2A, although the ejection openings 7 cannot be seen actually, in order to illustrate the position relationship with respect to the electro-thermal converting elements 2, the ejection openings are indicated by one-dot dashed lines.

As shown in FIGS. 2A and 2B, thickness-increased areas 102, 103 are provided on the element substrate 1 side of the flow path forming member 8. The thickness-increased areas 102, 103 as portions of the flow path forming member are formed integrally with the flow path forming member 8 (in the drawing, in order to clarify the areas, the areas are indicated by different shapes). In addition, the thickness-increased areas are not limited to this form, but other members may be adhered to the flow path forming member to form thickness-increased portions. In this manner, in the flow path forming member 8 according to the embodiment, a portion 8B facing a portion of the pressure chamber 6A and a portion of the ink flow path 6 has a thickness "a", and a part of a portion 8A facing the ink supply port 9 has a thickness "b" which is larger than the thickness "a". In the thickness-increased area 102, the portion having the thickness "b" extends from the ink supply port 9 to a portion entering the ink flow path 6. In addition, the thickness-increased area 103 is provided so as to bury the concave portion of the portion 8A of the flow path forming member. In addition, as shown in FIG. 2A, the thickness-increased areas 102, 103 extend corresponding to the range where the ejection openings 7 are arranged. Furthermore, the length of the thickness-increased area 102 that extends to enter the ink flow path can be defined by taking into consideration of characteristic or the like of ink supply from the ink supply port 9 to the pressure chamber 6A within a desired strength range which is to be obtained with respect to the flow path forming member. For example, the thickness of the flow path forming member 8 is set according to a necessary ink supply amount, elasticity of a sealing layer (not illustrated) in a periphery of the element substrate 1 and in an upper portion of an electrical connection portion, or the like.

In the related art, particularly, the flow path forming member has a form where the thickness-increased areas 102 do not exist, and thus, the flow path forming member is easily deformed by a force being exerted on the flow path forming member toward the element substrate 1. In contrast, as described above, the flow path forming member 8 in the embodiment particularly has the thickness-increased areas 102 to increase the thickness of the flow path forming member, and thus, it is possible to obtain a strength acting against the force being exerted on the flow path forming member toward the element substrate 1.

In the liquid ejection head where the thickness-increased areas are provided as described above, for example, a height "d" of the ink flow path 6B close to the ink supply port 9 can be set to be in a range of about 5 μm to 15 μm, and a height "c" of the ink flow path 6 at the same height of the pressure chamber 6A can be set to be in a range of about 10 μm to 30 μm. In this case, the thickness (b−a) of the thickness-increased area is at least 5 μm or more. In addition, the thickness of the flow path forming member 8 is in a range of about 20 μm to 80 μm, and the diameter of the ejection opening 7 is in a range of about 5 μm to 20 μm.

The advantageous effects of the above-described structure of the flow path forming member according to the first embodiment will be described through comparison with Comparative Examples.

Figures 3A, 3B:
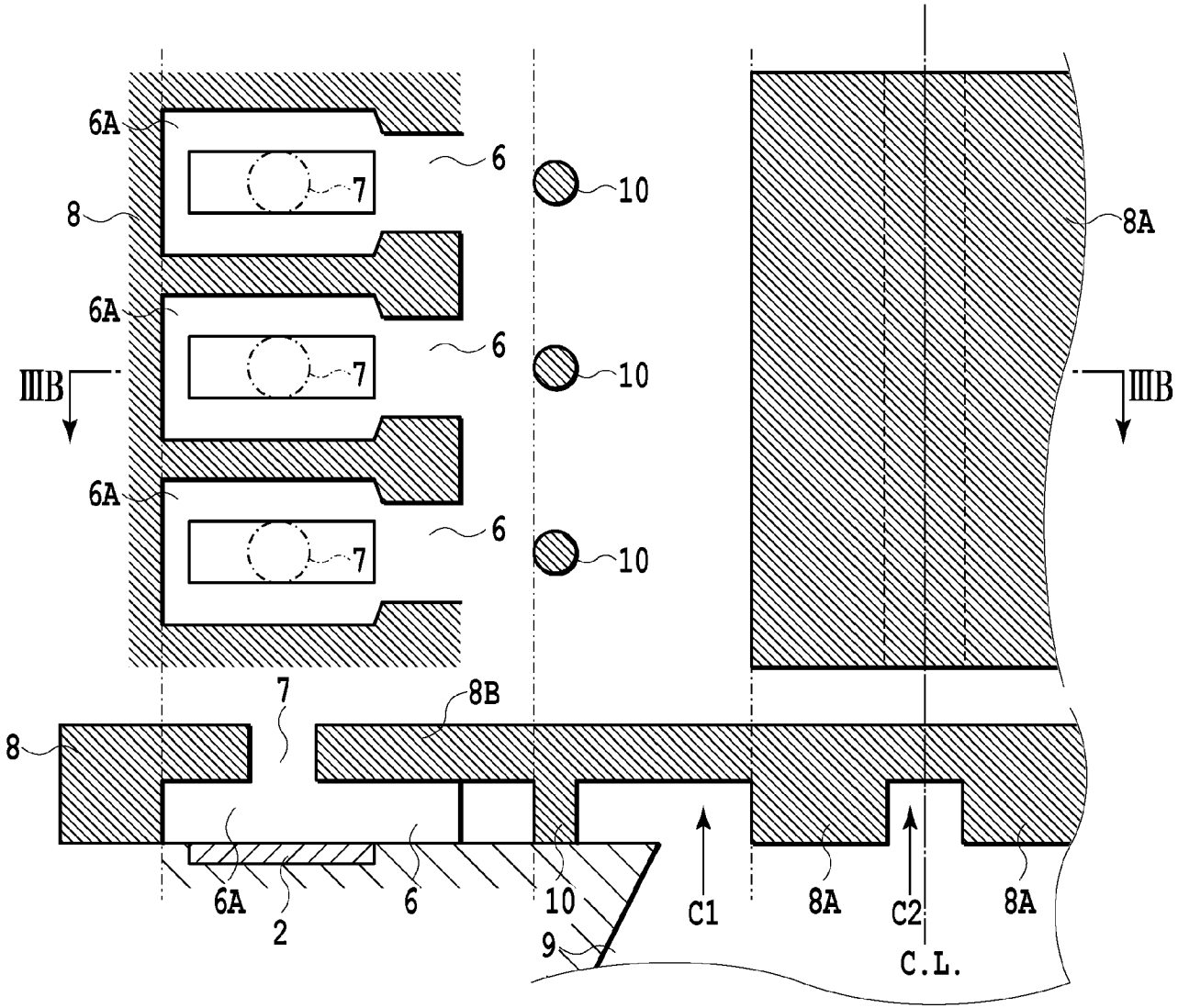
FIGS. 3A and 3B are views showing a structure of a liquid ejection head according to a first comparative example.

FIGS. 3A and 3B are views showing a structure of a liquid ejection head according to a first comparative example and are similar views as those of FIGS. 2A and 2B. The same components as those of FIGS. 2A and 2B are denoted by the same reference numerals, and the description thereof is omitted. As shown in FIGS. 3A and 3B, in the comparative example, cylindrical members 10 protruding toward the element substrate 1 are provided to a portion of the ink flow path 6 in the vicinity of the ink supply port 9. By allowing the cylindrical members 10 to be in contact with the element substrate 1, it is possible to prevent the flow path forming member 8 from being deformed toward the element substrate.

However, for some reasons, if a stress is exerted on the flow path forming member of the liquid ejection head, in the configuration of the comparative example shown in FIGS. 3A and 3B, particularly, the flow path forming member is easily deformed toward the substrate at the positions indicated by arrows C1 and C2 in FIG. 3B. More specifically, the flow path forming member according to the comparative example is easily deformed at the positions which are separated from the cylindrical member 10 and face the ink supply port 9, that is, the portions indicated by the arrows C1 and C2 in the drawings. As a result, for example, separation of the flow path forming member 8 from the substrate 1 may occur. If the separation occurs, desired ejection performance cannot be maintained.

Figures 4A, 4B:
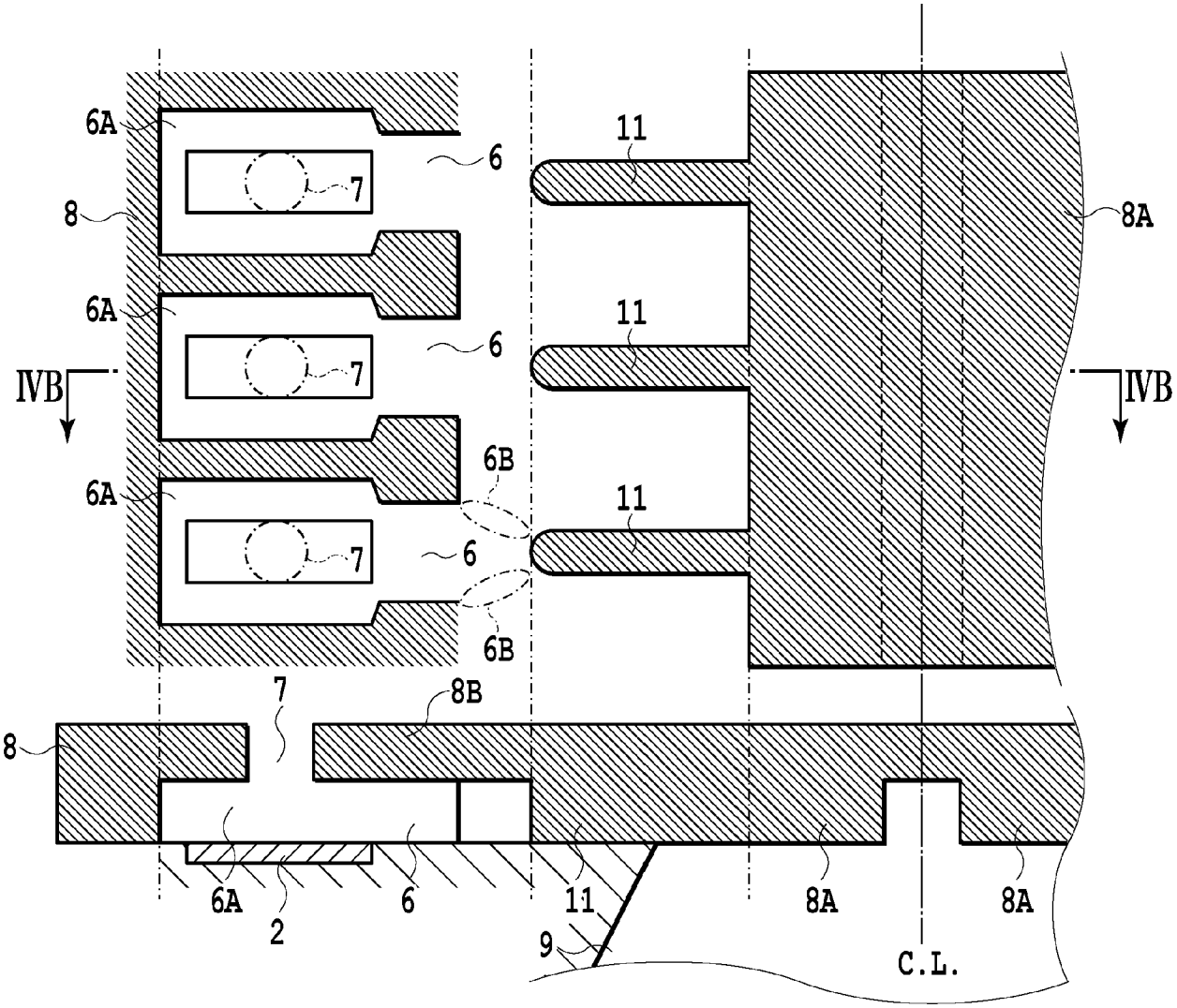
FIGS. 4A and 4B are views showing a structure of a liquid ejection head according to a second comparative example.

FIGS. 4A and 4B are views showing a structure of a liquid ejection head according to a second comparative example and are similar views as those of FIGS. 2A and 2B. The same components as those of FIGS. 2A and 2B are denoted by the same reference numerals, and the description thereof is omitted.

As shown in FIGS. 4A and 4B, in the comparative example, similarly to Japanese Patent Laid-Open No. 2007-283501, the flow path forming member 8 includes ribs 11 for respective ink flow paths. Therefore, as described in detail in the first comparative example, it is possible to prevent the flow path forming member 8 from being deformed at the position facing the ink supply port 9. In addition, the contact area between the element substrate 1 and the flow path forming member 8 is increased, the separation of the flow path forming member 8 from the substrate 1 does not easily occur.

However, as described above in Japanese Patent Laid-Open No. 2007-283501, in the form where the ink flow paths 6 are arranged at a high density, due to the existence of the ribs 11 corresponding to the ink flow paths 6, the communicating passages 6B between the ink flow paths 6 and the ink supply port 9 are narrowed, so that flow of ink between the ink flow paths 6 and the ink supply port 9 is obstructed.

In contrast of the comparative example described above, in the structure of the embodiment shown in FIGS. 2A and 2B, the thickness-increased area is provided from the portion which can be easily deformed and faces the ink supply port 9 to a portion of the ink flow path 6, and thus, the thickness of the flow path forming member is increased. Thereby, it is possible to increase a stiffness of the portion which can be easily deformed and faces the ink supply port 9. In addition, there is no portion of obstructing the flow of ink like the ribs 11 between the ink flow paths 6 and the ink supply port 9, and thus, it is possible to perform ink supply in a good manner. When the liquid ejection head including the flow path forming member according to the embodiment is installed in a printer and printing is performed, in comparison with the use time interval in the related art, the time interval when good printing can be performed is increased by two times or more.

FIGS. 5A to 5J are views explaining a method of manufacturing the liquid ejection head according to the embodiment.

Figure 5A:
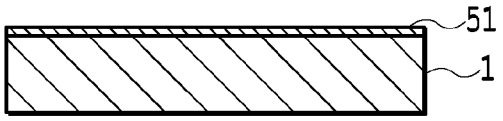
FIGS. 5A to 5J are views showing a method of manufacturing a liquid ejection head according to an embodiment.
Figure 5B:
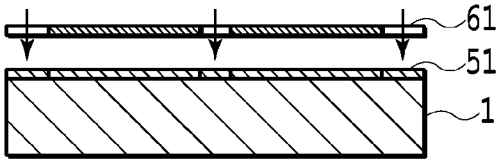

First, as shown in FIG. 5A, a first flow path pattern 51 which is a mold for forming flow paths is formed on the substrate 1 which is made of silicon and includes the energy generating elements 2. As a resist material which becomes the first flow path pattern, a photosensitive material is preferred in order to pattern a position relationship with respect to the energy generating elements 2 at a good accuracy. In the embodiment, polymethyl isopropenyl ketone (PMIPK) is used as a positive resist (positive photosensitive resin). As a method of forming a resist layer, there is a method of dissolving with an appropriate solvent and forming a coat film by a spin coat method or a roll coat method. At this time, as shown in FIG. 5B, pattern exposing is performed through a mask 61, so that the PMIPK is exposed with UV light having a photosensitive wavelength range of 260 nm to 300 nm.

Figure 5C:
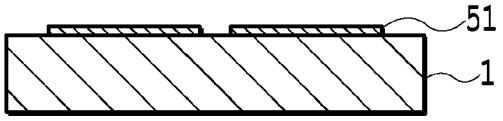
Figure 5D:
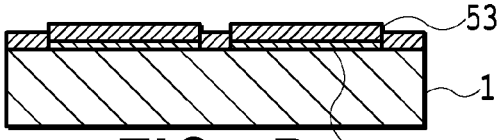

Next, as shown in FIGS. 5C and 5D, a second flow path pattern 53 for forming second flow paths is formed on the first flow path pattern 51. As a soluble resin (second positive photosensitive resin) constituting the second flow path pattern 53, a positive resist called PMMA is used. The PMMA is obtained by dissolving a binary copolymer (P(MMA-MAA) =90 to 70: 10 to 30) which is formed by radical polymerization of methyl methacrylate (MMA) and methacrylic acid (MAA) with a cyclohexanone solvent. A thermally cross-linked film (not illustrated) is formed by dehydration condensation reaction of the copolymer (P(MMA-MAA)) of the PMMA. In the dehydration condensation reaction, by heating at a temperature of 180 to 200° C. for 30 to 120 minutes, a stronger cross-linked film can be formed. In addition, the cross-linked film is in a form where the film is not dissolved with a solvent, but the cross-linked film is a positive resist where only the portion irradiated with electron beams such as DUV light can be dissolved with a solvent. Particularly, the PMMA is sensitive to UV light having a photosensitive wavelength range of 260 nm or less, and the PMIPK is sensitive to UV light having a photosensitive wavelength range of 260 nm to 300 nm. Thereby, the selective exposing can be performed by exposure wavelength. In addition, as the second positive photosensitive resin, the copolymer obtained by polymerizing a methacrylic acid to a methyl methacrylate which is a main component is illustrated. However, instead of the methacrylic acid, the second positive photosensitive resin may be formed by polymerization with a methacrylic anhydride. In addition, if the positive resist by which the selective exposure can be performed in this manner can be obtained, the first and second flow path patterns are limited to the above materials, and the forming method is not limited to the above method.

Figure 5E:
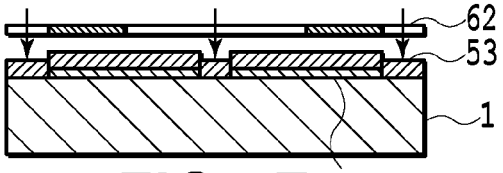
Figure 5F:
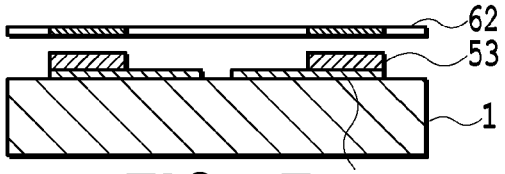

Next, as shown in FIGS. 5E and 5F, the mask 62 and an exposure apparatus which irradiates with DUV light are used, a filter which blocks UV light having a wavelength of 260 nm or more as a wavelength selecting unit is attached to the exposure apparatus, and the resist is irradiated with only the UV light having a wavelength of less than 260 nm. Thereby, it is possible to form the second flow path pattern 53 without exposing the first flow path pattern 51.

Figure 5G:
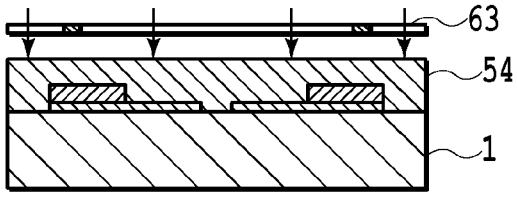
Figure 5H:
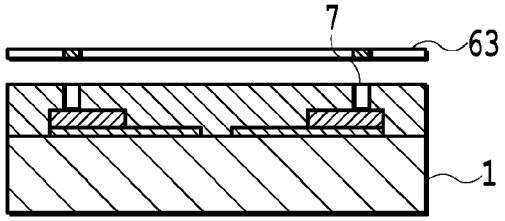
Figure 5I:
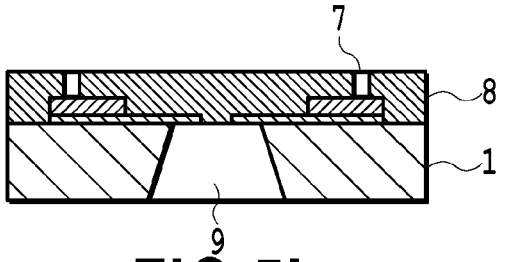
Figure 5J:
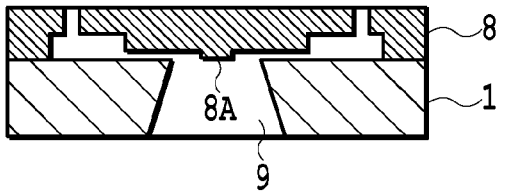

Next, as shown in FIGS. 5G and 5H, a second photosensitive coat resin layer 54 is applied, and pattern exposing is performed through a mask 63, so that the ejection openings 7 are formed. A high mechanical strength as a structure material of a flow path wall, adhesiveness to the element substrate 1, and solvent resistance are required for the photosensitive coat resin layer 54 used in this process. In addition, in order to perform patterning the position relationship between the communicating portion of the ejection openings 7 and the energy generating elements 2 at a high accuracy, a photosensitive one which can be formed in photolithography is preferred. Since the first flow path pattern 51 and the second flow path pattern 53 made of a soluble resin, need to be completely coated, coating with a corresponding thickness needs to be performed. In the embodiment, a negative photosensitive resin containing a cationic polymerizable compound and a photo cationic polymerization initiator is used. However, any material having the function may be used without limitation. After that, as illustrated in FIGS. 5I and 5J, the ink supply port 9 is formed on the element substrate 1 through etching or the like, and the first flow path pattern 51 and the second flow path pattern 53 are removed, so that the flow path forming member 8 is formed on the element substrate 1.

(Second Embodiment)

Figures 6A, 6B:
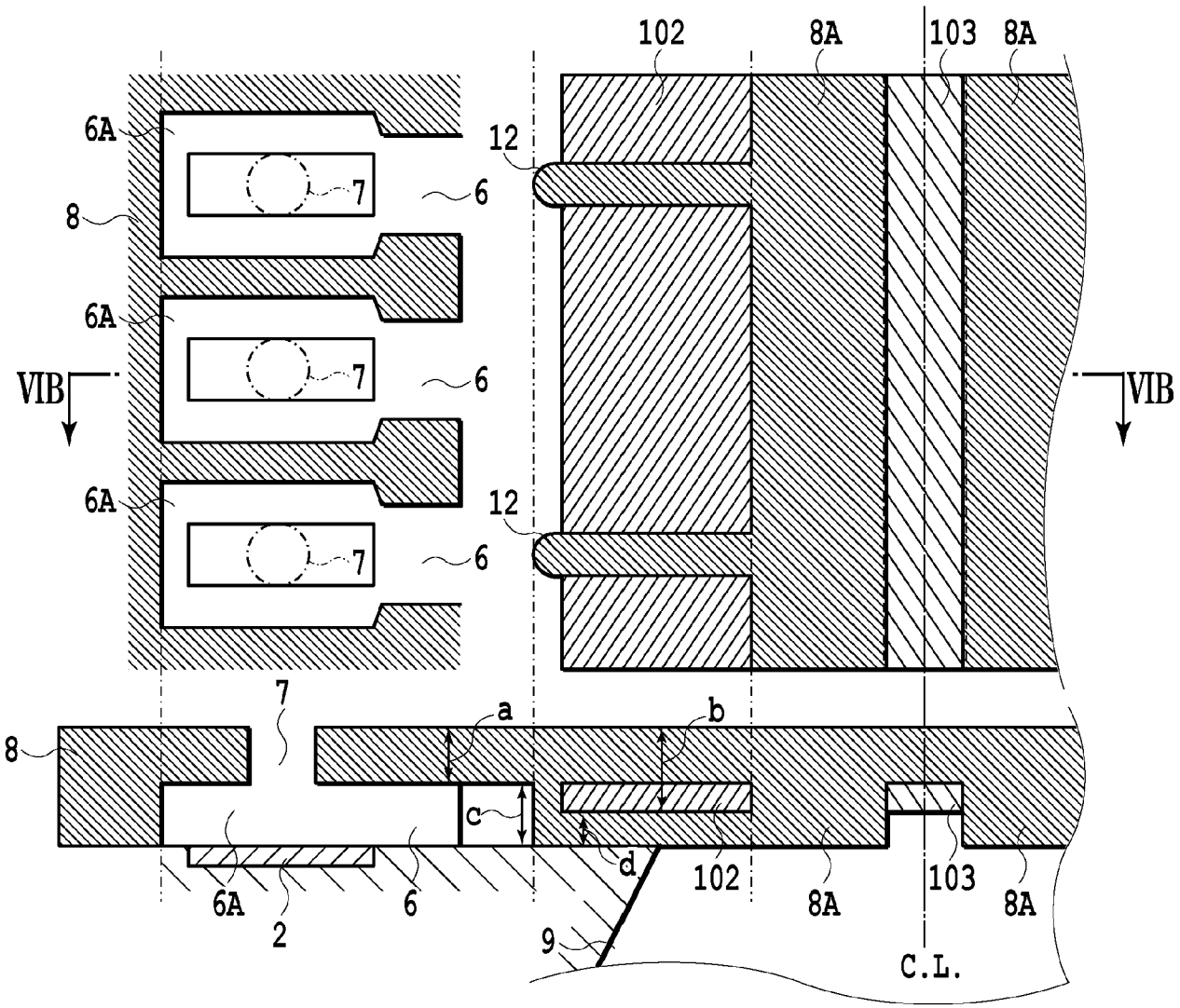
FIGS. 6A and 6B are views showing a structure of a liquid ejection head according to a second embodiment of the invention.

FIGS. 6A and 6B are views showing a structure of a liquid ejection head according to a second embodiment and are similar views as those of FIGS. 2A and 2B. The same components as those of FIGS. 2A and 2B are denoted by the same reference numerals, and the description thereof is omitted.

The embodiment is different from the liquid ejection head according to the first embodiment in that a rib 12 extending toward the element substrate 1 is provided at least at one position of the flow path forming member 8 facing the ink flow path 6. The rib 12 is in close contact with the element substrate 1. Namely, in this embodiment, in addition to the thickness-increased areas 102 and 103 according to the first embodiment, the ribs 12 are provided at a predetermined interval in the arrangement direction of the ejection openings 7. Therefore, when a stress deforming the flow path forming member 8 occurs, stress concentration can be reduced in a stepped portion (boundary portion) existing in the flow path forming member 8. As a result, in comparison with the first embodiment, the stiffness of the flow path forming member 8 facing the ink supply port 9 is further increased, so that the deformation of the flow path forming member 8 can be reduced.

In this embodiment, the ribs 12 are arranged in an area between the ink flow paths 6 and the ink supply port 9, and the ribs are arranged at an interval of one rib for the two ink flow paths 6. The arrangement interval is not limited thereto, but it is preferable that many ribs are arranged within a range where there is no problem in terms of the ink ejection performance by taking into consideration the arrangement density and shape of the ink flow paths 6. Thereby, it is possible to further reduce the deformation of the flow path forming member 8 facing the ink supply port 9. When the liquid ejection head including the flow path forming member according to the embodiment is installed in a printer and printing is performed, in comparison with a period of use in the related art, the period of use when good printing can be performed is increased by two times or more, and thus, it is possible to obtain the period of use which is equal to or longer than that of the first embodiment.

(Third Embodiment)

Figures 7A, 7B:
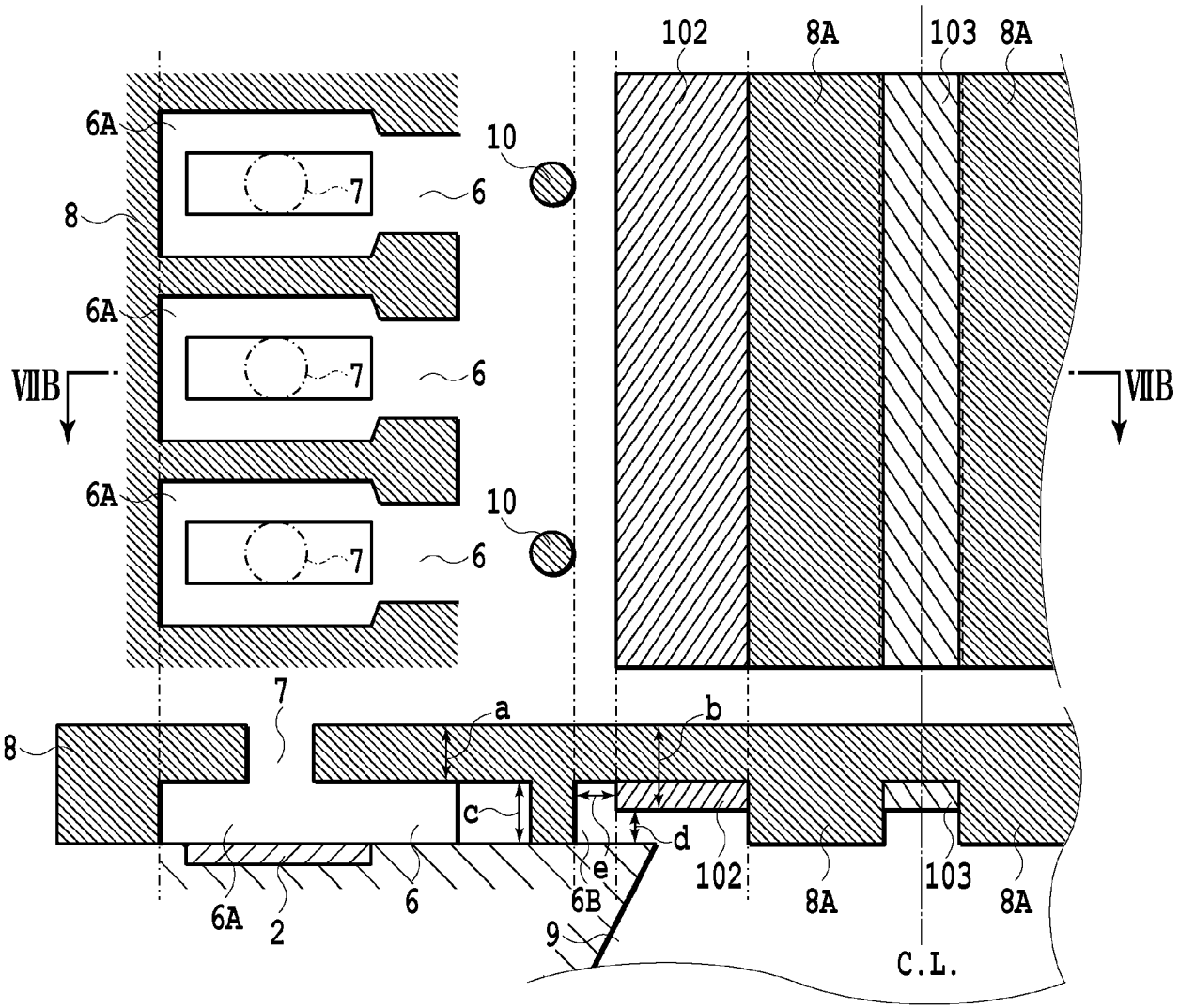
FIGS. 7A and 7B are views showing a structure of a liquid ejection head according to a third embodiment of the invention.

FIGS. 7A and 7B are views showing a structure of a liquid ejection head according to a third embodiment and are similar views as those of FIGS. 2A and 2B. The same components as those of FIGS. 2A and 2B are denoted by the same reference numerals, and the description thereof is omitted.

In the embodiment, similarly to the comparative example shown in FIGS. 3A and 3B, the cylindrical members 10 are provided. In addition, the extension length of the thickness-increased area 102 is shortened by a predetermined length from the cylindrical member 10 toward the ink supply port 9 in comparison with the first embodiment shown in FIGS. 2A and 2B.

In some cases, according to physical properties of ink used in a printer, the thickness of the flow path forming member 8 in the vicinity of the ink supply port 9 has a great influence on the ink ejection performance. More specifically, the thickness of the flow path forming member 8 at the flow paths in the periphery of the cylindrical members 10 communicating with the respective ink flow paths 6 is maintained further to the position of the ink supply port 9 side, so that the thickness of the flow path forming member 8 is made small. Thereby, it is possible to prevent the flow resistance of the ink flow paths 6 from being increased by the thickness-increased areas of the flow path forming member 8, and thus, for example, the liquid ejection head can be used for ink having a high viscosity.

At this time, a relationship between the height "c" of the ink flow path 6B and a distance "e" from the position where the height "c" of the flow path corresponding to the thickness-increased area is changed to the cylindrical member 10 is defined by a relationship of "distance e>height (c−d)". For example, in the case where the "d" is 10 μm and the height "c" is 15 μm, the distance "e" from the cylindrical member 10 is smaller than 5 μm, which is about 3 μm.

According to the above embodiment, in the case where the force causing the flow path forming member 8 to be convex in the direction opposite to the ink supply port 9 is exerted, the flow path forming member 8 is deformed so that the distance "e" from the cylindrical member 10 is decreased. In this case, according to the above-described relationship "distance e>height (c−d)", with respect to the deformation of the above-described convex-shaped flow path forming member 8, it is possible to prevent the deformation by interference of the stepped portion of the thickness-increased area 102 of the flow path forming member 8 with the cylindrical member 10.

(Other Embodiment)

Figure 8A:
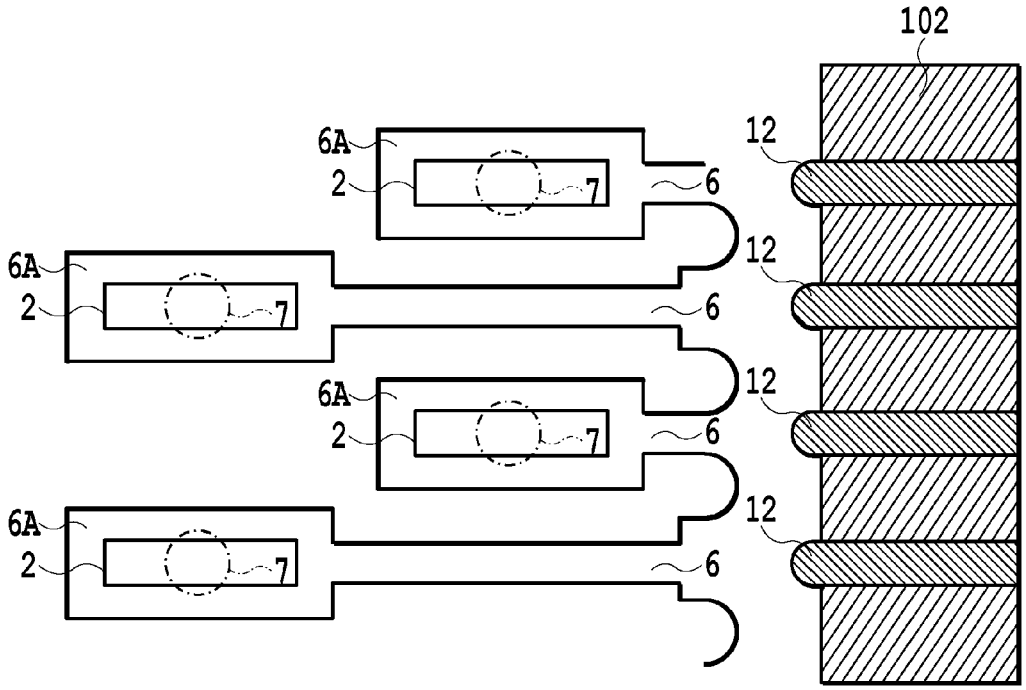
FIGS. 8A and 8B are views showing a structure of a liquid ejection head according to a fourth embodiment of the invention.
Figure 8B:
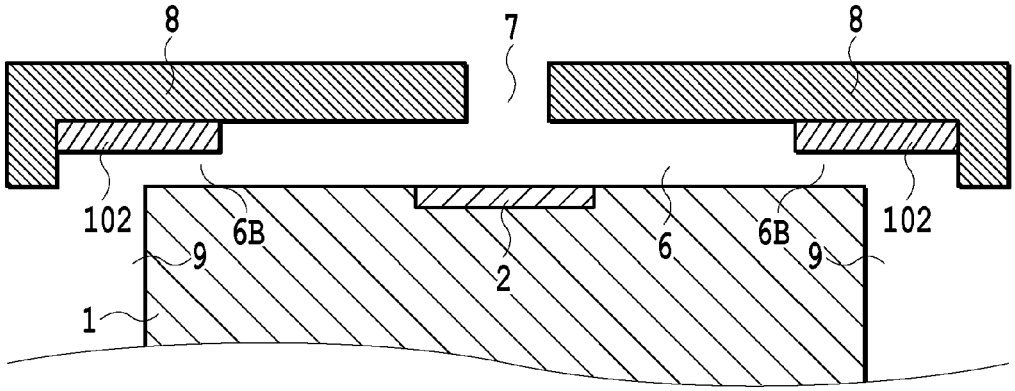

FIGS. 8A and 8B are views showing two structures of liquid ejection heads according to other embodiment and are similar views as those of FIGS. 2A and 2B. The same components as those of FIGS. 2A and 2B are denoted by the same reference numerals, and the description thereof is omitted.

In the structure of the liquid ejection head shown in FIG. 8A, the energy generating elements 2 are arranged in a zigzag shape, for example, at a density of 2400 dpi. On the other hand, in the structure shown in FIG. 8B, ink is supplied from each ink supply port 9 through the ink flow paths 6 of the two sides in the direction substantially perpendicular to the arrangement direction of the energy generating elements.

In the embodiments, the thickness-increased areas 102 are also provided to the portions of the flow path forming member 8 facing the ink supply ports 9. Therefore, the thickness of the flow path forming member 8 is increased at the positions where the flow path forming member is easily deformed, and thus, it is possible to increase the strength of the flow path forming member 8. Other configurations of the flow path forming member and other configurations of the cylindrical members 10 which are columnar beam-shaped portions are in accordance with those of any one of the first to third embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-188146 filed Sep. 25, 2015, which is hereby incorporated by reference herein in its entirety.

What is claimed is:

1. A liquid ejection head for ejecting a liquid, the liquid ejection head comprising:

a substrate provided with an energy generating element and a liquid supply port;

a flow path forming member including an ejection opening for ejecting a liquid; and a pressure chamber communicating with the ejection opening and including the energy generating element therein and a flow path through which the pressure chamber and the liquid supply port communicate with each other, the pressure chamber and the flow path being provided between the substrate and the flow path forming member, wherein a first portion of the flow path forming member which extends from an area facing the liquid supply port to an area facing a part of the flow path extending from the liquid supply port to the pressure chamber has a thickness greater than that of a second portion of the flow path forming member which faces the pressure chamber, and as viewed from a direction in which the liquid is ejected from the ejection opening, a third portion having a thickness greater than that of the first portion is provided in an area of the flow path forming member overlapping with the liquid supply port.

2. The liquid ejection head according to claim 1, wherein the flow path forming member includes a rib in the first portion, and the rib extends along a direction toward the pressure chamber and has a thickness greater than a thickness of the first portion.

3. The liquid ejection head according to claim 2, wherein a plurality of ribs are arranged along an array direction of the energy generating elements and the ribs are provided in an area between the pressure chamber and the liquid supply port.

4. The liquid ejection head according to claim 1, wherein the flow path forming member includes a cylindrical member in the first portion, and the cylindrical member is provided at a pressure chamber side of a boundary between areas of the flow path forming member which have different thicknesses.

5. An inkjet printing apparatus that performs printing on a print medium by ejecting ink, the apparatus comprising:

a liquid ejection head for ejecting ink, the liquid ejection head comprising a substrate provided with an energy generating element and a ink supply port, a flow path forming member including an ejection opening for ejecting ink, and a pressure chamber communicating with the ejection opening and including the energy generating element therein and a flow path through which the pressure chamber and the ink supply port communicate with each other, the pressure chamber and the flow path being provided between the substrate and the flow path forming member, wherein a first portion of the flow path forming member which extends from an area facing the ink supply port to an area facing a part of the flow path extending from the ink supply port to the pressure chamber has a thickness greater than that of a second portion of the flow path forming member which faces the pressure chamber, and as viewed from a direction in which the liquid is ejected from the ejection opening, a third portion having a thickness greater than that of the first portion is provided in an area of the flow path forming member overlapping with the ink supply port; and a printing unit configured to communicate with the liquid ejection head and cause the liquid ejection head to eject ink onto the print medium for performing the printing.

6. The inkjet printing apparatus according to claim 5, wherein the flow path forming member includes a rib in the first portion, and the rib extends along a direction toward the pressure chamber and has a thickness greater than a thickness of the first portion.

7. The inkjet printing apparatus according to claim 6, wherein a plurality of ribs are arranged along an array direction of the energy generating elements and the ribs are provided in an area between the pressure chamber and the ink supply port.

8. The inkjet printing apparatus according to claim 5, wherein the flow path forming member includes a cylindrical member in the first portion, and the cylindrical member is provided at a pressure chamber side of a boundary between areas of the flow path forming member which have different thicknesses.

* * * * *